US010704755B2

(12) United States Patent
Hadrath

(10) Patent No.: US 10,704,755 B2
(45) Date of Patent: Jul. 7, 2020

(54) LIGHTING APPARATUS

(71) Applicant: OSRAM GmbH, Munich (DE)

(72) Inventor: Stefan Hadrath, Falkensee (DE)

(73) Assignee: OSRAM Beteiligungsverwaltung GmbH, Grünwald (DE)

( * ) Notice: Subject to any disclaimer, the term of this patent is extended or adjusted under 35 U.S.C. 154(b) by 0 days.

(21) Appl. No.: 16/323,260

(22) PCT Filed: Jul. 14, 2017

(86) PCT No.: PCT/EP2017/067929
§ 371 (c)(1),
(2) Date: Feb. 5, 2019

(87) PCT Pub. No.: WO2018/024470
PCT Pub. Date: Feb. 8, 2018

(65) Prior Publication Data

US 2019/0178460 A1 Jun. 13, 2019

(30) Foreign Application Priority Data

Aug. 5, 2016 (DE) ..... 10 2016 214 517

(51) Int. Cl.
*F21S 41/176* (2018.01)
*F21S 41/20* (2018.01)
(Continued)

(52) U.S. Cl.
CPC ..... *F21S 41/176* (2018.01); *F21S 41/14* (2018.01); *F21S 41/16* (2018.01); *F21S 41/28* (2018.01);
(Continued)

(58) Field of Classification Search
None
See application file for complete search history.

(56) References Cited

U.S. PATENT DOCUMENTS 10,422,499 B2 * 9/2019 Lenef ..... F21S 41/192
2011/0148280 A1 6/2011 Kishimoto et al.
(Continued)

FOREIGN PATENT DOCUMENTS

DE 102012220472 A1 5/2014
DE 102012220481 A1 5/2014
(Continued)

OTHER PUBLICATIONS

International Search Report based on application No. PCT/EP2017/067929 (6 pages + 3 pages English Translation) dated Oct. 20, 2017 (for reference purpose only).
(Continued)

*Primary Examiner* — Britt D Hanley

(57) ABSTRACT

A lighting apparatus may include a light generating device for generating a primary light beam, a phosphor body that can be irradiated by means of the primary light beam and serves for partly converting primary light of the primary light beam into secondary light, and a spectral filter disposed downstream of the phosphor body. The spectral filter may be more highly transmissive to the secondary light than to the primary light where the spectral filter is arranged along a beam axis of the primary light beam incident on the phosphor body. The lighting apparatus may be used in LARP arrangement for vehicle lighting, general lighting, exterior lighting, stage lighting, effect lighting, etc.

13 Claims, 3 Drawing Sheets

(51) Int. Cl.

| | |
|---|---|
| ***F21S 45/70*** | (2018.01) |
| ***F21S 41/14*** | (2018.01) |
| ***F21S 41/16*** | (2018.01) |
| ***F21V 9/20*** | (2018.01) |
| ***F21V 9/30*** | (2018.01) |
| ***F21V 23/04*** | (2006.01) |
| ***F21S 41/255*** | (2018.01) |
| ***F21Y 115/30*** | (2016.01) |

(52) U.S. Cl.
CPC ..... *F21S 41/285* (2018.01); *F21S 45/70* (2018.01); *F21V 9/20* (2018.02); *F21V 9/30* (2018.02); *F21V 23/0457* (2013.01); *F21S 41/255* (2018.01); *F21Y 2115/30* (2016.08)

(56) References Cited

U.S. PATENT DOCUMENTS

| | | | | |
|---|---|---|---|---|
| 2011/0157865 | A1 | 6/2011 | Takahashi et al. | |
| 2014/0169015 | A1 | 6/2014 | Chen | |
| 2016/0033112 | A1 | 2/2016 | Weissenberger | |
| 2017/0191636 | A1* | 7/2017 | Khrushchev | F21V 9/14 |
| 2017/0307164 | A1 | 10/2017 | Atoji | |
| 2018/0274770 | A1* | 9/2018 | Fischer | F21S 41/32 |

FOREIGN PATENT DOCUMENTS

| | | | | |
|---|---|---|---|---|
| DE | 102014215221 | A1 | 2/2016 | |
| DE | 102014221098 | A1 | 4/2016 | |
| DE | 102015213861 | A1 | 1/2017 | |
| DE | 102015224438 | A1 | 6/2017 | |
| EP | 2297827 | A2 | 3/2011 | |
| JP | 5866521 | B1 * | 2/2016 | B60Q 1/04 |
| JP | 2016088425 | A | 5/2016 | |
| WO | 2010004477 | A2 | 1/2010 | |

OTHER PUBLICATIONS

German Search Report based on application No. 10 2016 214 517.7 (8 pages) dated Mar. 1, 2017 (for reference purpose only).

* cited by examiner

LIGHTING APPARATUS

CROSS-REFERENCE TO RELATED APPLICATION

The present application is a national stage entry according to 35 U.S.C. § 371 of PCT application No.: PCT/EP2017/067929 filed on Jul. 14, 2017, which claims priority from German Patent Application Serial No.: 10 2016 214 517.7, which was filed Aug. 5, 2016; both of which are incorporated herein by reference in their entirety and for all purposes.

TECHNICAL FIELD

The disclosure relates to an illumination apparatus, having a light generation device for generating a primary light beam and a phosphor body, which is able to be illuminated using the primary light beam, for partially converting primary light into secondary light. The illumination apparatus may be applicable for example to LARP arrangements. The illumination apparatus may be particularly advantageously utilizable for purposes of vehicle illumination, ambient illumination, exterior illumination, stage illumination, effect illumination etc.

BACKGROUND

DE 10 2012 220 472 A1 discloses a motor vehicle illumination apparatus having a laser light source for emitting a primary light bundle in a primary solid angle region around a primary emission direction. The illumination apparatus includes a phosphor or photoluminescence element, which is arranged such that the primary light bundle that is emittable using the laser light source is incident on the photoluminescence element, for example, via an intermediate optical unit or beam guidance means, and which is configured such that a secondary light distribution is emittable using photoluminescence due to the incident primary light bundle. In addition, an emission optical device is provided, which is configured such that the secondary light distribution is convertible into an emission light distribution of the illumination apparatus. To increase safety, an emission inhibition means is provided, which is configured and arranged such that the conversion into the emission light distribution is suppressible for those light bundles that travel, starting from the laser light source, in the primary solid angle region around the primary emission direction.

SUMMARY

The description relates to at least partially overcoming the disadvantages of the prior art and to provide an improved possibility for homogenizing a light emission pattern emitted by a phosphor body in terms of color using simple means, in particular for LARP arrangements.

An illumination apparatus may have a light generation device for generating a primary light beam, a phosphor body configured to be irradiated using the primary light beam, for partially converting primary light of the primary light beam into secondary light, and a spectral filter connected optically downstream of the phosphor body and is configured to be more strongly transmissive for the secondary light than for the primary light. The spectral filter may be arranged along a beam axis of the primary light beam that is incident on the phosphor body.

In a non-limiting embodiment, the phosphor body emits as useful light partially converted secondary light and non-converted primary light. That means that the useful light is mixed light. The primary light portion of the useful light is here frequently more strongly directed than the secondary light, specifically in the direction of the beam axis of the primary light beam that is incident on the phosphor body. For example, the primary light portion can have a conical or lobe shape, while the secondary light is emitted with a practically Lambertian emission pattern, where different divergence angles can occur in different emission directions. Consequently, the useful light has a primary light portion that is considerably increased with respect to a predetermined sum color location of the mixed light in a (solid angle or spatial) region extending directly around the beam axis. This is followed by a "neutral" region, the sum color location of which at least approximately corresponds to the predetermined sum color location of the mixed light. Even further away from the beam axis, the mixed light can have an increased secondary light portion. The increased secondary light portion is here less perceivable to a viewer than the much more strongly localized (solid angle or spatial) region having an increased primary light portion.

This illumination apparatus provides the advantage that, owing to the stronger filtering of the primary light portion in the region of the beam axis beyond the spectral filter, the increase of the primary light portion here can be attenuated or even entirely eliminated. Consequently, color homogenization of the light emission pattern emitted by the phosphor body is again achieved by simple means. If a color-independent increase of the luminance as compared to a surrounding region also occurs in this region, homogenization of the brightness distribution of the light emission pattern emitted by the phosphor body is also achieved.

The predetermined (total) color location can be a color location specified for the useful light. The predetermined total color location can also be a color region or color band. The surface of the spectral filter can be designed with respect to its shape and its size such that the total color location of a "central" angle region of the light emission pattern through which the beam axis extends corresponds to the predetermined total color location.

In a non-limiting embodiment, the phosphor body is situated at a distance from the light generation device or from the at least one light source thereof. This offers the advantage of comparatively simple cooling.

The light generation device can have one or more light sources. If a plurality of light sources are present, the individual light beams produced thereby can be directed separately onto the phosphor body (in one non-limiting embodiment also onto a respective phosphor body). Alternatively, the individual light beams can be combined to form a common light beam.

At least one light source can be a light-emitting semiconductor structural element ("semiconductor light source"), e.g. a light-emitting diode or a laser diode. The at least one light-emitting diode can be present in the form of at least one single light-emitting diode package or in the form of at least one LED chip. A plurality of LED chips can be mounted on a common substrate ("submount"). Instead of or in addition to inorganic light-emitting diodes, e.g. based on InGaN or AlInGaP, generally also organic LEDs (OLEDs, e.g. polymer OLEDs) may be used. However, the light source is not limited to semiconductor light sources and can also be, e.g., a different type of laser.

According to a further refinement, the light generation device has at least one laser—in particular a semiconductor laser—and the phosphor body is arranged at a distance from the at least one laser. Such a light generation device, also referred to as LARP ("laser activated remote phosphor"), has inter alia the advantages of high luminance and comparatively simple cooling. In addition, the primary light beam generated by the at least one laser is already advantageously collimated to a high extent, which means that a complicated optical unit between the at least one laser and the phosphor body is not needed.

According to another non-limiting embodiment, the primary light beam generated by the light generation device (in particular the at least one laser) is directly incident on the phosphor body.

According to yet another non-limiting embodiment, at least one optical element is located between the light generation device and the phosphor body, for example in order to suitably shape the primary light beam, e.g., for beam expansion, beam focusing onto the phosphor body etc., and/or in order to divert a beam direction of the primary light beam, e.g., by way of a fiber-optic waveguide and/or a mirror and/or by way of an oscillating mirror in the form of a MEMS mirror or of a DMD (digital mirror device).

The phosphor body being connected optically downstream of the light generation device may in particular include the phosphor body being able to be irradiated by the primary light. In particular, a surface region of the phosphor body onto which the primary light is incident (also referred to below without limiting the general nature as "light spot") is located entirely on the phosphor body.

The light spot can be oval or elliptically elongated or be circular. According to a non-limiting embodiment, the light spot has a diameter of between 300 μm and 500 μm.

The phosphor body can consist of a wavelength-converting ceramic and be present in particular in the form of a ceramic plate. The ceramic plate in one non-limiting embodiment can have a lateral extent (e.g., a diameter) of approximately 1 to 2 mm.

The phosphor body includes at least one phosphor which is suitable for at least partially converting incident primary light into secondary light of a different wavelength. If a plurality of phosphors are present, these may produce secondary light of mutually different wavelengths. The wavelength of the secondary light may be longer (so-called "down conversion") or shorter (so-called "up conversion") than the wavelength of the primary light. For example, blue primary light may be converted to green, yellow, orange or red secondary light using a phosphor. In the case of an only partial wavelength conversion, a mixture of secondary light and non-converted primary light is emitted by the phosphor body, which can serve as useful light. For example, useful white light can be produced from a mixture of blue, non-converted primary light and yellow secondary light. However, full conversion is also possible, in which case the useful light is either no longer present in the useful light, or is present only as a negligible portion. A degree of conversion depends, for example, on a thickness and/or a phosphor concentration of the phosphor. If a plurality of phosphors are present, secondary light portions of different spectral compositions can be produced from the primary light, e.g. yellow and red secondary light. The red secondary light may be used, for example, to give the useful light a warmer hue, e.g. so-called "warm white." If a plurality of phosphors are present, at least one phosphor may be suitable for wavelength-converting secondary light again, e.g. green secondary light to red secondary light. Such light that has been wavelength-converted again from a secondary light may also be referred to as "tertiary light."

The phosphor body can be arranged on a light-transmissive carrier, e.g., a sapphire carrier. The sapphire carrier can also serve for heat dissipation. The carrier can in particular be a transparent carrier.

The spectral filter being connected optically downstream of the phosphor body may include the spectral filter being irradiated by useful light that is emitted by the phosphor body when the illumination apparatus is switched on.

According to a non-limiting embodiment, the spectral filter is arranged at a distance from the phosphor body. This offers the advantage that a surface of the spectral filter can be manufactured with greater measurement tolerances and/or the spectral filter can occupy a particularly small region (i.e., a solid angle region or spatial region). In addition, heating of the spectral filter can in this way be kept low. Alternatively, the spectral filter can be arranged at a short distance of a few millimeters from the exit surface of the phosphor body in order to cover the central region of the emission as completely as possible. In a further variant, the spectral filter can also be applied or arranged directly on the exit side of the phosphor body.

In another refinement, the spectral filter is located only in a primary-light-dominated region of the mixed light emitted by the phosphor body (i.e., a region having a significantly increased primary light portion). This offers the advantage that the primary light is not also reduced in the already secondary-light-dominated solid angle or spatial region (i.e., a region having a significantly increased secondary light portion). However, the spectral filter can also extend for example slightly beyond the primary-light-dominated region so as to make it possible to keep manufacturing tolerances low.

According to a further refinement, the spectral filter covers the entire primary-light-dominated (solid angle or spatial) region of the light emission pattern. This gives the advantage that homogenization of the useful-light emission pattern is supported particularly effectively.

According to yet a further refinement, the primary light beam extends centrally through the spectral filter or through a center point of the spectral filter. As a result, the primary light portion can be reduced in a "core" of the useful-light emission pattern that is symmetrical about the beam axis, which in the case of a typically symmetrical shape of the useful-light emission pattern further supports the homogenization thereof.

According to a non-limiting embodiment, a surface of the spectral filter projected along the beam axis corresponds to a shape of a beam cross section of the primary light beam. According to a non-limiting embodiment, a surface of the spectral filter projected along the beam axis is circularly round or symmetrically elongated (e.g., oval or elliptical).

According to a non-limiting embodiment, the spectral filter is arranged in an intermediate image plane of an imaging lens system.

The spectral filter being more strongly transmissive for the secondary light than for the primary light means in particular that transmittance Ts for the secondary light is greater than transmittance Tp for the primary light, i.e., $Ts>Tp$. Generally, it may be advantageous for approaching the predetermined total color location if the spectral filter is predominantly non-transmissive for the primary light, in particular if Tp is less than 10%, less than 5%, or less than 1%. According to a non-limiting embodiment which is advantageous for particularly effectively blocking the primary light portion at the peak luminous intensity thereof, the spectral filter is practically non-transmissive ($Tp<1\%$) for the primary light.

It can also be advantageous for approaching the predetermined total color location that the spectral filter is practically transmissive for the secondary light, i.e., Ts>80%, in particular Ts>90%, in particular Ts>95%.

In the case of blue primary light and yellow secondary light, a filter edge of the spectral filter can be located for example at approximately 470 nm.

According to a further refinement, the spectral filter is a dichroic mirror. This offers the advantage that the spectral filter is able to particularly precisely separate the primary light and the secondary light, is compact and is easily producible.

According to another refinement, the illumination apparatus has a light sensor, which is arranged such that primary light that is incident on the dichroic mirror is reflectable into the light sensor. As a result, a light quantity (e.g. a luminous flux) of the light reflected by the dichroic mirror can be measured. For example, damage of the phosphor body and/or failure of the light generation device can in this way be detected. The dichroic mirror can to this end be positioned at an angle with respect to the beam axis of the primary light beam. The angled position can generally be advantageous to prevent back-reflection of the primary light into the light generation device.

According to a non-limiting embodiment, the light sensor is a light sensor that is sensitive for the primary light and the secondary light. It can advantageously evaluate particularly great luminous flux. To detect damage of the phosphor body, it can be assumed, for example, that, if damage has occurred, the primary light is converted into secondary light less strongly than before (e.g. due to missing phosphor, due to cracks etc.), and for this reason a smaller portion of the secondary light produced by the phosphor body is incident on the dichroic mirror, or a greater luminous flux of the primary light. For this reason, an increase of the primary light that is incident in the light sensor or a decrease in secondary light can indicate damage.

According to another non-limiting embodiment, the light sensor is a light sensor that is sensitive only for the primary light (and not for the secondary light). If damage has occurred, a strong increase in the primary light that is incident in the light sensor can indicate damage.

According to another non-limiting embodiment, the light sensor is a light sensor that is sensitive only for the secondary light (and not for the primary light). If damage has occurred, a decrease in the secondary light that is incident in the light sensor can indicate damage.

According to another non-limiting embodiment, the light sensor is sensitive separately on the one hand for the primary light and on the other hand for the secondary light or the mixed useful light (primary light and secondary light) or includes two different light sensors, specifically one light sensor that is sensitive only for the primary light and one light sensor that is sensitive only for the secondary light or for the useful light. This non-limiting embodiment offers the advantage that fluctuations in the primary luminous flux from the light generation device can now also be taken into account and in this way wrong detections of damage can be avoided even better. For example, an increase in the primary luminous flux from the light generation device can be detected by way of both the luminous flux of the primary light portion that is incident in the (at least one) light sensor and the luminous flux of the incident secondary light portion increasing.

According to an additional refinement, the illumination apparatus has a control device, which is coupled to the light sensor and the light generation device and is set up to evaluate a measurement signal of the light sensor with respect to damage of the phosphor body and to reduce a luminous flux of the primary light emitted by the light generation device upon detection of damage. In this way, possible damage to the eyes caused by exiting collimated primary light with high luminous flux can be particularly reliably prevented. Reducing the luminous flux may include reducing but not switching off ("dimming") the luminous flux, for example in order to still maintain weak emergency lighting. However, reducing the luminous flux may also include deactivating or switching off the primary light.

The angular position of the dichroic mirror is here selected in particular such that light it reflects back substantially is not incident again on the conversion element. Depending on the size of the dichroic mirror and of the spatial or angular region to be covered, a suitable angular position of the mirror with respect to the optical beam axis can be selected for this purpose. The value range of the angular position can be for example between 10° and 80°, in particular between 30° and 55°, in particular between 40° and 50°. The dichroic mirror can have a rectangular, polygonal, circular or freeform shape.

According to an additional refinement, the spectral filter is arranged on a transmitted-light element that is connected optically downstream of the phosphor body. This can simplify production and arrangement. Such a transmitted-light element can be, e.g., a lens or a cover plate. The lens or the cover plate can be constituent parts of a LARP module and terminate it in the emission direction. However, the cover plate can also be a component of the illumination apparatus outside the LARP module, for example a cover plate of a headlight or a spotlight.

According to yet another refinement, the spectral filter is mounted on a side of the transmitted-light element that faces away from the phosphor body, the primary light is reflectable by the spectral filter through the transmitted-light element to a side that faces the phosphor body, and the side that faces the phosphor body is configured in the region of the reflected primary light as a TIR-free region. In this refinement, useful light thus travels through the transmitted-light element and is reflected back by the spectral filter through the transmitted-light element. The TIR-free region has the effect that the light that travels back in the transmitted-light element is not reflected back into the transmitted-light element due to total internal reflection at the side facing the phosphor body, but is coupled out of the transmitted-light element.

Alternatively, the spectral filter can be mounted on a side of the transmitted-light element that faces the phosphor body. In another alternative, the spectral filter can be arranged within the body.

According to yet another refinement, the transmitted-light element is a beam-shaping transmitted-light element. The transmitted-light element can in particular be a light-refracting element such as a lens, a collimator, an imaging lens system etc. This refinement makes possible a particularly compact construction. In the case of an imaging lens system, the spectral filter may be arranged in the intermediate image plane of the light spot. According to an alternative non-limiting embodiment, the transmitted-light element is not a beam-shaping but a beam-neutral transmitted-light element, for example a cover plate, on which the spectral filter is located or in which it is integrated.

According to an additional refinement, the spectral filter has a diameter of between 100 μm and 300 μm.

According to a non-limiting embodiment, the illumination apparatus has, connected downstream of the phosphor body, a further spectral filter, which is more strongly transmissive for the primary light than for the secondary light and which is arranged in a secondary-light-dominated region of the useful light. In this way, even regions which are further removed from the beam axis of the incident primary light beam can be shifted in the direction of the predetermined sum color location of the useful light, which can even further homogenize a color distribution of the light emission pattern.

According to yet another refinement, the illumination apparatus is a headlight or a spotlight. The headlight or spotlight can have a cover made of glass or plastic. According to a non-limiting embodiment, the spectral filter is arranged on the cover.

According to yet another refinement, the illumination apparatus is a vehicle illumination apparatus. The vehicle can be a motor vehicle (e.g. an automotive vehicle such as a passenger car, truck, bus etc. or a motorcycle), a railway vehicle, a vessel (e.g. a boat or a ship) or an aircraft (e.g. a plane or a helicopter). However, the illumination apparatus can also be used for purposes of ambient illumination, external illumination, stage illumination, effect illumination etc.

The above-described properties and the manner in which they are achieved, will become clearer and significantly more comprehensible in connection with the following schematic description of exemplary embodiments, which will be explained in more detail in connection with the drawings. For the sake of clarity, the same elements or elements having the same effect can be provided with the same reference signs.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the illumination apparatus. In the following description, various aspects are described with reference to the following drawings, in which.

DETAILED DESCRIPTION

Figure 1:
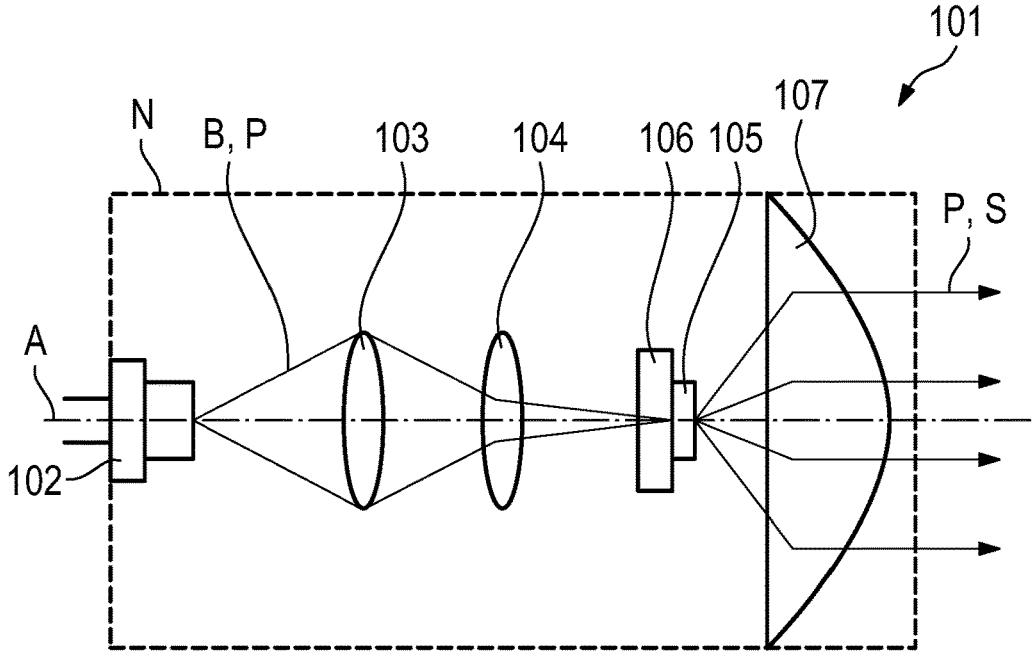
FIG. 1 shows a side view as a sectional representation of a LARP illumination apparatus without a spectral filter.

FIG. 1 shows a sectional representation of a LARP illumination apparatus 101 without a spectral filter.

The LARP illumination apparatus 101 has a light generation device in the form of a laser diode 102 for generating a (primary light) beam B of blue primary light P. Two lenses 103 and 104 for beam-shaping the primary light beam B are connected optically downstream of the laser diode 102. The primary light beam B is incident on a phosphor body in the form of a converting ceramic plate 105, specifically along a beam axis A.

The ceramic plate 105 can be applied on a carrier 106 made of transparent sapphire, glass etc. The ceramic plate 105 is used to convert some of the primary light P into yellow secondary light S. Emitted by the ceramic plate 105 is consequently blue-yellow, or white, mixed light having a portion of primary light P and a portion of secondary light S as useful light P, S. A transmitting arrangement is present here, in which the useful light P, S is emitted by a side of the ceramic plate 105 that faces away from the laser diode 102. However, in principle a reflecting arrangement may also be used, in which the useful light P, S is emitted by the same side of the ceramic plate 105 on which the primary light P, or the primary light beam B, is also incident (the ceramic plate 105 can in that case be applied, e.g., on a reflective carrier). The useful light P, S can be beam-shaped, e.g., collimated, by a further beam-shaping transmitted-light element, here in the form of a further lens 107. The components 102 to 107 can be components of a LARP module N.

Figure 2:
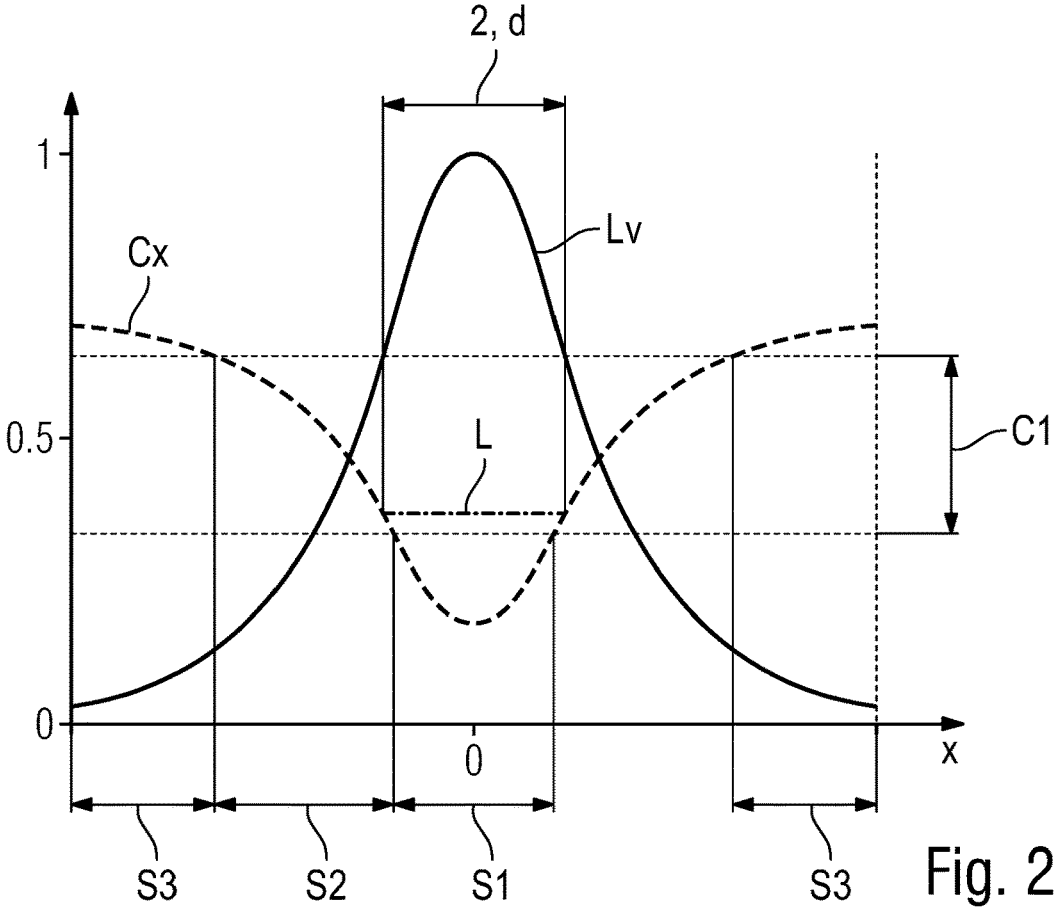
FIG. 2 shows a profile of a luminance of the primary light beam and of a sum color location of the useful light along an angle section that is symmetrical with respect to the beam axis.
Figure 3:
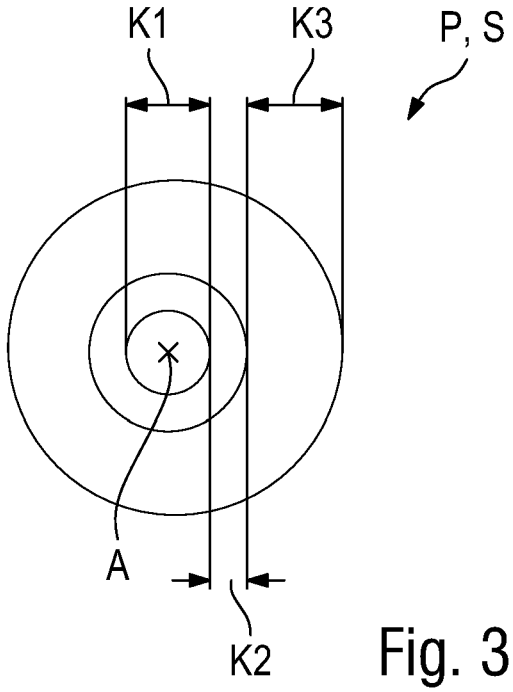
FIG. 3 shows a view along a beam axis of a light emission pattern of the useful light of the LARP illumination apparatus from FIG. 1.

FIG. 2 shows a profile of a luminance Lv of the primary light beam B and of a sum color location Cx of the useful light P, S on a light exit surface of the ceramic plate 105 along a direction x perpendicular to the optical beam axis A. This yellow-blue spatial region can have different extents in different directions perpendicular to the optical beam axis A, with the result that an elliptical color profile is obtained for example in the exit plane of the ceramic plate 105. However, the color profile can also be rotation-symmetrical with respect to the beam axis A, as is illustrated in FIG. 3. The beam axis A is incident centrally on the spatial region shown.

The luminance Lv has a maximum at the location of the beam axis A and decreases as the distance from it increases. The sum color location Cx of the useful light P, S has a blue hue in a first section including the beam axis A ("central section" S1). That means that the portion of the blue primary light P is here so high that the sum color location Cx is situated outside a neutral white color band C1, specifically in the direction of the color location of the primary light P, i.e., shifted to blue.

This is followed toward the outside, or with increasing distance x from the optical beam axis A, by a "neutral" section S2, in which the sum color location Cx is in the neutral white color band C1. With even more distance from the beam axis A, here in an "external section" S3, the sum color location Cx has a yellow hue. That means that the portion of the yellow secondary light S is here so high that the sum color location Cx has shifted to yellow and is situated outside the neutral white color band C1.

The transitions between the region S1, S2 and S3 are not abrupt or in the shape of steps, but exhibit a gradual transition that depends on the beam profile of the primary light P and the properties of the converting ceramic plate 105, such as, e.g., the phosphor concentration thereof and distribution of possible scatter regions.

FIG. 3 shows a rotation-symmetrical light emission pattern of the useful light P, S of the LARP illumination apparatus 101, which is centered around the beam axis A, without a spectral filter, specifically on the exit side of the converting ceramic plate 105 in a view along the beam axis A in a plane perpendicular to the beam axis A. A central region K1, which corresponds to the central section S1 in FIG. 2, is here configured in the shape of a circle and centered around the central axis A. The central region K1 is surrounded by an annular neutral region K2 which corresponds to the neutral section S2. The neutral region K2 in turn is surrounded by an annular external region K3 which corresponds to the external section S3. Generally, the color profile, or the light emission pattern, on the exit side of the conversion element can be oval or elliptical.

Figure 4:
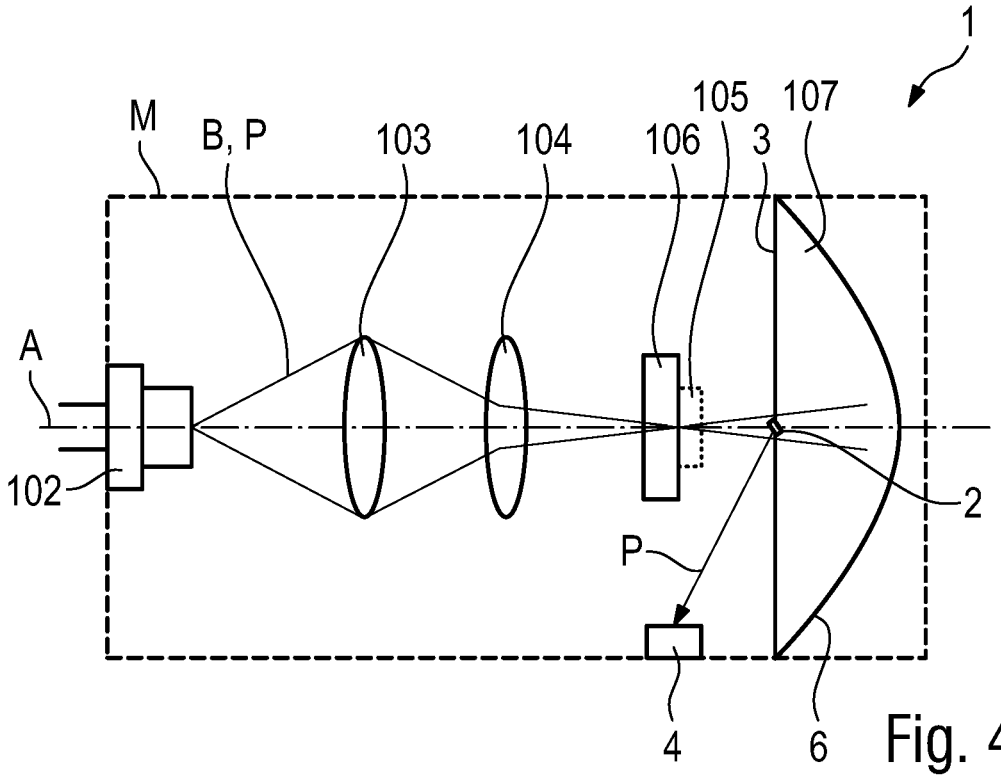
FIG. 4 shows a side view as a sectional representation of a first LARP illumination apparatus with a spectral filter.

FIG. 4 shows a side view as a sectional representation of a first LARP illumination apparatus 1, with a construction similar to the LARP illumination apparatus 101, but now additionally with a spectral filter in the form of a dichroic mirror 2. The dichroic mirror 2 is more strongly transmissive for the yellow secondary light S than for the blue primary light P.

The dichroic mirror 2 is mounted on the further lens 107, specifically on a side 3 that faces the laser diode 102. The dichroic mirror 2 is arranged here along the beam axis A, specifically such that it substantially completely covers the primary light P emitted by the central region S1 (and possibly also a small part of the primary light emitted by the neutral region S2), as is stated in FIG. 2 for the spatial region. The dichroic mirror 2 to this end has an oval or circularly round shape and is inclined with respect to the beam axis A such that its surface that is projected along the beam axis A corresponds to the shape of the central region K1. The surface of the dichroic mirror 2 that is projected along the beam axis A has a specified diameter d, as is also indicated in FIG. 2. This diameter d is selected such that the primary-light-dominated (spatial or solid angle) region is entirely covered and possibly—as illustrated in FIG. 2—even goes slightly beyond it. The diameter d can be for example at least between 100 μm and 300 μm. However, the regions K1, K2 and/or K3 can alternatively have a non-circularly round shape, e.g., be elongated, for example elliptical. The dichroic mirror 2 may be arranged at a small distance from the converting ceramic plate 105, for example in the region of a few millimeters.

Consequently, the blue primary light P is attenuated downstream of the dichroic mirror 2. If a ceramic plate 105 that is not damaged (indicated here by dots) is present, the portion of the primary light P in the useful light P, S is consequently reduced in the central region K1, specifically in a manner such that the useful light here has a sum color location in the neutral white color band C1. With reference to FIG. 2, this is indicated by the dotted line L.

However, if the ceramic plate 105 is damaged or has even fallen off the carrier 106, the primary light beam P is incident on the dichroic mirror 2 with its greatest luminance and is reflected by said mirror into a light sensor 4. This offers the advantage of improved eye safety, because the primary light P can leave the illumination apparatus 1 only in a strongly attenuated state.

In addition, a strongly increased incident luminous flux is ascertained by the light sensor 4 in the case of a ceramic plate 105 that is damaged or has fallen off, as a result of which the existence of damage (including falling off of the ceramic plate 105) is reliably ascertainable. Due to the fact that damage has been ascertained, the primary light beam B can be dimmed, for example, or entirely switched off, e.g., using a control device (not illustrated) which is coupled or connected both to the laser diode 102 and to the light sensor 4.

This illumination apparatus 1 can represent a headlight/spotlight or part thereof (for example a LARP module M), in particular a headlight for a vehicle.

Figure 5:
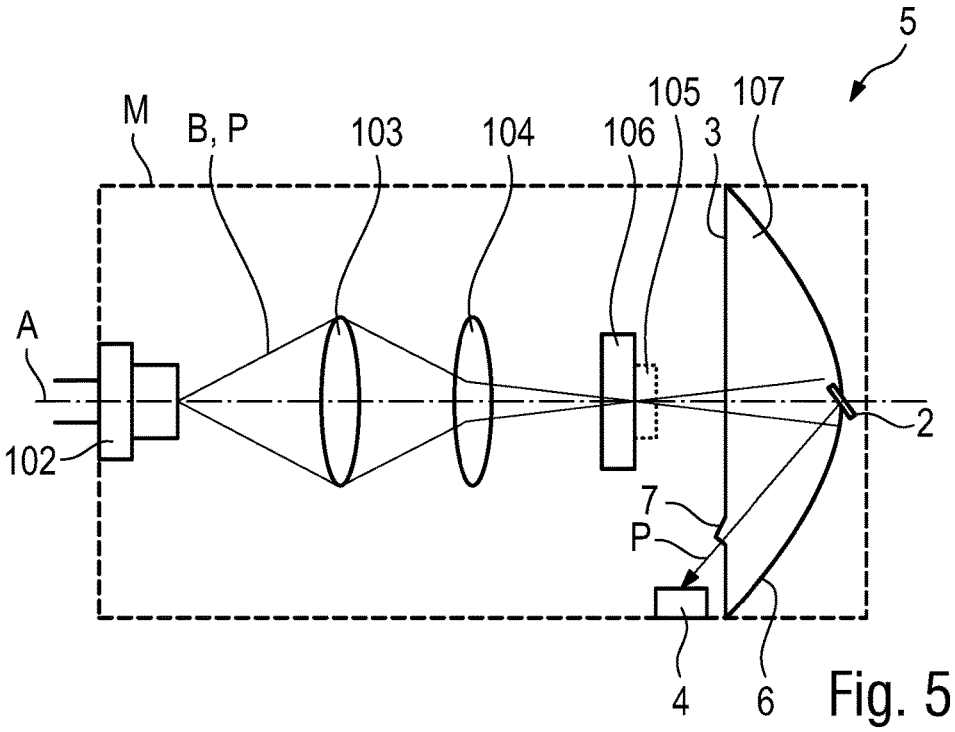
FIG. 5 shows a side view as a sectional representation of a second LARP illumination apparatus with a spectral filter.

FIG. 5 shows a side view as a sectional representation of a second LARP illumination apparatus 5 with the dichroic mirror 2. The LARP illumination apparatus 5 is similar in design to the LARP illumination apparatus 1, although here, the dichroic mirror 2 is attached to a side 6 of the further lens 107 which faces away from the ceramic plate 105. At least the primary light P emitted by the central core region K1 is able to be reflected back by the dichroic mirror 2 through the lens 107 to the side 3 that faces the ceramic plate 105. On an incidence region of the back-reflected primary light P, the side 6 is formed as a TIR-free region 7.

Figure 6:
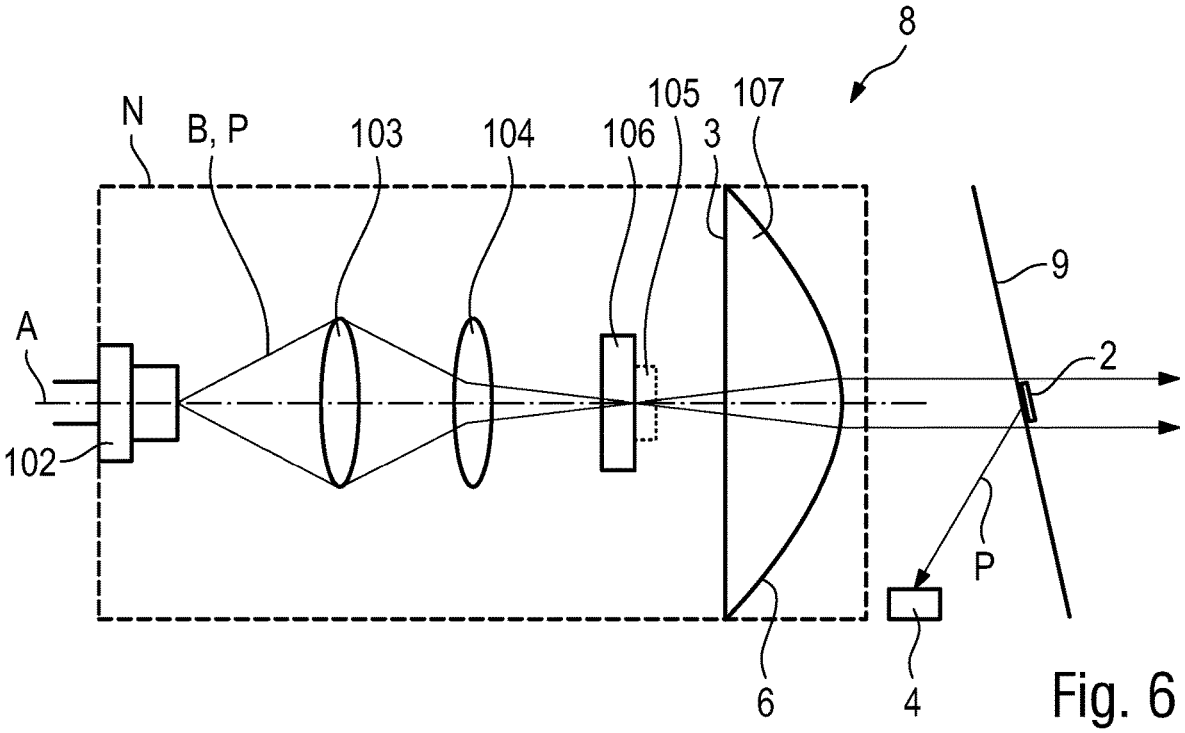
FIG. 6 shows a side view as a sectional representation of a third LARP illumination apparatus with a spectral filter.

FIG. 6 shows a side view as a sectional representation of a third LARP illumination apparatus 8 with the dichroic mirror 2. The LARP illumination apparatus 8 can be configured in the form of a vehicle headlight with a LARP module N as per FIG. 1, connected downstream of which is a transmitted-light element in the form of a front-side cover plate 9. The LARP illumination apparatus 8 is similar in design to the LARP illumination apparatus 1 or 4, wherein the dichroic mirror 2 is now attached to the cover plate 9. The cover plate 9, the dichroic mirror 2 and the light sensor 4 here do not represent components of the LARP module N.

Although the illumination apparatus has been further illustrated and described in detail by way of the non-limiting embodiments shown, the illumination apparatus is not limited thereto, and other variations can be derived herefrom by a person skilled in the art without departing from the scope of protection of the illumination apparatus.

For example, in a further non-limiting embodiment, instead of the lens 107, an imaging lens system, for example in non-limiting embodiment that images 1:1, may be present, which produces an intermediate image of the spot profile located on the focal plane (luminance and color distribution) of the emission surface of the converting ceramic plate 105. The dichroic mirror 2 is then arranged in an intermediate image plane on the optical beam axis A inclined with respect to said beam axis A, with the result that the light reflected by the dichroic mirror 2 is incident on a sensor 4 which is arranged at a distance, as is shown analogously in FIG. 5*a*.

Generally, in addition to a ceramic plate 105, another wavelength-changing conversion body may also be present.

Generally, "a" or "an" can be understood to mean a singular or a plural, in particular in the sense of "at least one" or "one or more" etc., unless this is explicitly ruled out, e.g. by the expression "exactly one" etc.

A mention of a number may also include both the stated number and a customary tolerance range, unless this is explicitly ruled out.

While specific aspects have been described, it should be understood by those skilled in the art that various changes in form and detail may be made therein without departing from the spirit and scope of the aspects of this disclosure as defined by the appended claims. The scope is thus indicated by the appended claims and all changes that come within the meaning and range of equivalency of the claims are therefore intended to be embraced.

LIST OF REFERENCE SIGNS

LARP illumination apparatus 1
Dichroic mirror 2
Side 3
Light sensor 4
LARP illumination apparatus 5
Side 6
TIR-free region 7
LARP illumination apparatus 8
Cover plate 9
LARP illumination apparatus 101
Laser diode 102

Lens 103
Lens 104
Ceramic plate 105
Carrier 106
Lens 107
Beam axis A
Primary light beam B
Neutral white color band C1
Sum color location Cx
Diameter d
Central region K1
Neutral region K2
External region K3
Luminance Lv
LARP module M
LARP module N
Primary light P
Secondary light S
Central section S1
Neutral section S2
External section S3
Angle α

The invention claimed is:

1. An illumination apparatus, comprising a light generation device for generating a primary light beam, a phosphor body configured to be irradiated using the primary light beam, for partially converting primary light of the primary light beam into secondary light, and a spectral filter connected downstream from the phosphor body and configured to be more strongly transmissive for the secondary light than for the primary light, wherein the spectral filter is arranged along a beam axis of the primary light beam that is incident on the phosphor body, and the spectral filter (2) covers the entire primary-light-dominated region of a light emission pattern of the phosphor body (105); and further comprising a light sensor (4) arranged such that primary light (P) incident on the spectral filter (2) is able to be reflected into the light sensor (4); and wherein the spectral filter (2) is applied on a side (6) of the transmitted-light element (107) that faces away from the phosphor body (105);

the primary light (P) is able to be reflected by the spectral filter (2) through the transmitted-light element (107) to a side (3) that faces the phosphor body (105); and the side (3) that faces the phosphor body (105) in the region of the reflected primary light (P) takes the form of a TIR-free region.

2. The illumination apparatus as claimed in claim 1, wherein the beam axis extends centrally through the spectral filter.

3. The illumination apparatus as claimed in claim 1, wherein the spectral filter is a dichroic mirror.

4. The illumination apparatus as claimed in claim 1, wherein the illumination apparatus has a control device coupled to the light sensor and the light generation device and is set up to evaluate a measurement signal of the light sensor with respect to damage of the phosphor body and to reduce a luminous flux of the primary light beam emitted by the light generation device upon detection of damage.

5. The illumination apparatus as claimed in claim 1, wherein the spectral filter is arranged on a transmitted-light element connected optically downstream from the phosphor body.

6. The illumination apparatus as claimed in claim 5, wherein the transmitted-light element is an imaging transmitted-light element and the spectral filter is arranged in an intermediate image plane.

7. The illumination apparatus as claimed in claim 1, wherein the spectral filter has a diameter between 100 μm and 300 μm.

8. The illumination apparatus as claimed in claim 1, wherein the light generation device has at least one semiconductor laser and the phosphor body is arranged at a distance from the at least one semiconductor laser.

9. The illumination apparatus as claimed in claim 1, wherein the illumination apparatus is a headlight or a spotlight.

10. The illumination apparatus as claimed in claim 1, wherein the illumination apparatus is a vehicle illumination apparatus.

11. The illumination apparatus as claimed in claim 1, wherein a surface of the spectral filter that is projected along the beam axis corresponds to the shape of a primary-light-dominated central region of the emission.

12. The illumination apparatus as claimed in claim 1, wherein a primary-light-dominated central region of the emission is completely covered by the surface of the spectral filter that is projected along the beam axis.

13. The illumination apparatus as claimed in claim 3, further comprising a light sensor arranged such that primary light incident on the dichroic mirror is able to be reflected into the light sensor.

* * * * *